US009615660B2

(12) United States Patent
Hogeback

(10) Patent No.: US 9,615,660 B2
(45) Date of Patent: Apr. 11, 2017

(54) WINE RACK CAROUSEL

(71) Applicant: Darryl Hogeback, Denver, CO (US)

(72) Inventor: Darryl Hogeback, Denver, CO (US)

( * ) Notice: Subject to any disclaimer, the term of this patent is extended or adjusted under 35 U.S.C. 154(b) by 0 days.

(21) Appl. No.: 15/004,102

(22) Filed: Jan. 22, 2016

(65) Prior Publication Data

US 2016/0213143 A1 Jul. 28, 2016

(51) Int. Cl.
*A47B 73/00* (2006.01)
*A47B 49/00* (2006.01)

(52) U.S. Cl.
CPC ..... *A47B 73/00* (2013.01); *A47B 49/00* (2013.01); *A47B 49/004* (2013.01)

(58) Field of Classification Search
CPC ..... A47F 5/04; A47F 5/02; A47F 5/10; A47F 5/0018; A47F 7/28; A47F 5/13; A47F 5/01; A47F 5/05; A47B 3/002; A47B 55/02; A47B 47/021; A47B 73/002
USPC ..... 211/74, 163, 133.4, 205, 131.1, 181.1, 211/133.2, 133.5, 126.8, 126.9, 85.31, 211/112, 78, 70, 144, 33, 37, 41.4, 90.3, 211/106; D6/677.2, 680.3, 681.3; D7/704, 707; 108/139, 151, 59, 94
See application file for complete search history.

(56) References Cited

U.S. PATENT DOCUMENTS 208,938 A * 10/1878 Turner ..... A47B 57/26 108/151
234,452 A * 11/1880 Ayres ..... A47B 57/26 108/151
1,699,367 A * 1/1929 McCosh ..... A47F 5/05 211/163
1,711,587 A * 5/1929 Brunhoff ..... A47F 5/02 211/163
3,150,778 A * 9/1964 Gurian ..... A47F 5/02 211/181.1
3,266,634 A * 8/1966 Tintary ..... A47F 5/02 211/131.1
3,489,289 A * 1/1970 Scott-Fenton ..... B25H 3/06 211/70.6
D251,046 S * 2/1979 Landwehr ..... D6/514
4,253,576 A * 3/1981 Ford ..... A47F 7/12 211/163
D393,388 S * 4/1998 Chen ..... D6/513
6,502,707 B1 * 1/2003 Sullivan ..... A47F 7/08 211/144
D627,611 S * 11/2010 Cash ..... D6/677.2
8,607,994 B1 * 12/2013 Schneider ..... A47B 73/00 211/106
2010/0006523 A1 * 1/2010 Hogeback ..... A47F 7/28 211/74

* cited by examiner

*Primary Examiner* — Daniel J Troy
*Assistant Examiner* — Hiwot Tefera
(74) *Attorney, Agent, or Firm* — Russell T. Manning; Marsh Fischmann & Breyfogle LLP

(57) ABSTRACT

A wine rack carousel for storing a plurality of wine bottles comprising one or more inner annular frames and outer annular frames where a plurality of support member pairs, extend between each pair of inner and outer annular frames to support wine bottles. Each pair of support members are parallel.

11 Claims, 7 Drawing Sheets

WINE RACK CAROUSEL

CROSS REFERENCE

The present application claims the benefit of the filing date of U.S. Provisional Application No. 62/106,467 having a filing date of Jan. 22, 2015, the entire contents of which is incorporated herein by reference.

FIELD OF THE INVENTION

Embodiments of the present invention relate to wine racks, and more particularly to a wine rack carousel suitable for storing and displaying wine bottles horizontally as supported on a pair of substantially parallel dowels extending between concentric annular frames.

BACKGROUND OF THE INVENTION

Conventionally, wine racks are used in wine cellars or other wine storage areas to store numerous bottles of wine in a desired area. In such conventional wine racks, the bottles of wine are supported along the length of the bottle within a grid of generally rectangular cavities stacked upon and next to each other, each rectangular cavity typically formed by pairs of parallel wood supports held in position by front and rear frame structures.

These wine racks are generally solidly built wooden structures, and the cavities are capable of storing one or more bottles of wine vertically stacked on top of each other. Thus, the nature of these types of wine racks generally results in the bottles being stored in close proximity to each other, preventing air circulation around the individual bottles and providing inadequate measures for securing the wine bottles in the event the rack is bumped, jostled or otherwise moves. Therefore, wine bottles may fall off the rack resulting in loss of the product and a significant mess to clean.

Also, in this example of a conventional wine rack, the wine rack is typically configured such that user places a bottle of wine longitudinally within one of the rectangular cavities such that when the rack is full of wine bottles, only the top ends (i.e., where the foil is wrapped around the top end) of the wine bottles are generally visible when viewing the wine rack—and the labels on the wine bottle are not generally visible by the user. Accordingly, viewing wine labels is often difficult. Many wine collectors and retailors desire to more fully display their wine bottles.

It is, against this background that various embodiments of the present invention were developed.

SUMMARY OF THE INVENTION

In light of the above and according to one broad aspect of one embodiment of the invention, disclosed herein is a wine rack carousel that allows viewing the labels of multiple wine bottles while permitting a user to rotate the carousel to view different wine bottles.

The embodiments of the present invention provide a wine rack apparatus having inner and outer concentric annular frames (e.g., circular) configured for storing wine bottles in a radial pattern. Multiple wine bottle supports extend between the inner and outer annular frames to support a wine bottle. Each support comprises a pair of spaced-apart dowels generally parallel to one another and extending between the inner and outer annular frames. Each pair of dowels is spaced apart sufficiently to support a wine bottle or the like thereon. When the pair of dowels are parallel to one another, the bottle is evenly supported along its length. In a further arrangement, multiple sets of inner and outer frames may be spaced and stacked about a common central axis (e.g., central axis of the annular frames). In this arrangement, the wine rack carousel may have multiple tiers. In any arrangement, the inner and outer annular frames may be coupled about a central support to permit their rotation. When the wine rack has multiple tiers, each tier may, in one arrangement, rotate free of any adjacent tier. However, this is not a requirement.

In one embodiment, two rows of wine bottles may be supported about the periphery of the wine rack carousel. In such an embodiment, one row of wine bottles may be supported substantially perpendicular to a central axis of the annular frames (e.g., by a first set of perpendicular supports) and a second row of wine bottles may be supported at an angle to the central axis (e.g., by a second set of angled supports). In one arrangement, the perpendicular and angled supports may alternate about the outside periphery of the inner annular frame and, hence, the inside periphery of the outer annular frame. Further, each row of wine bottles may alternate the orientation of the supported wine bottle. For instance, the perpendicular row may support wine bottle necks pointing outward while the angled row may support wine bottle necks inward. In this arrangement, the inner annular frame may include apertures that allow the neck of the bottle to at least partially extend there through. Likewise, the inner frame may include apertures or recesses that allow necks of the angled bottles to at least partially extend through the inner frame. In another embodiment, the outer frame may include apertures or recesses that permit bottle necks to at least partially extend beyond the outer frame. The number of bottles that can be supported by the rack is dependent on the circumference of the inner and outer annular frames.

Use of dowel pairs for each wine bottle support provides for improved air circulation around each bottle and provides easy viewing of the labels of bottles in the rack. Further, the spacing of the dowels may be selected to accommodate different bottle configurations. For instance, champagne and magnum wine bottles are typically differently sized than most standard wine bottles. Accordingly, components of the wine rack apparatus may be sized for different applications.

Other embodiments of the invention are disclosed herein. The foregoing and other features, utilities and advantages of various embodiments of the invention will be apparent from the following more particular description of the various embodiments of the invention as illustrated in the accompanying drawings and claims.

DETAILED DESCRIPTION

Reference will now be made to the accompanying drawings, which assist in illustrating the various pertinent features of the wine rack carousel. Although the invention will now be described primarily in conjunction with a rack system for holding wine bottles, it should be expressly understood that the invention may be applicable to other applications where it is desired to hold and display other bottled items. In this regard, the following description of a wine rack design is presented for purposes of illustration and description. Furthermore, the description is not intended to limit the invention to the form disclosed herein. Consequently, variations and modifications commensurate with the following teachings, and skill and knowledge of the relevant art, are within the scope of the design. The embodiments described herein are further intended to explain modes known of practicing the invention and to enable others skilled in the art to utilize the invention in such, or other embodiments and with various modifications required by the particular application(s) or use(s) of the design.

The present application recognizes that for many wine enthusiasts, the proper storage of individual wine bottles is very important. For instance, wine collectors often spend considerable sums of money on wine collections. Accordingly, storage systems for wine are of considerable importance to such collectors and should share a number of important features. For instance, it is desirable that individual wine bottles be stored in a generally horizontal position. It is also desirable that the wine bottles be spaced to permit airflow between individual bottles. Finally, it is also desirable that the bottles be secured within a storage system such that the bottles are not permitted to unintentionally fall from the storage system upon the storage system being bumped or otherwise shaken.

In addition, it may be desirable for a wine rack system to allow for viewing of individual labels without having to remove a wine bottle from the wine rack. Further, it may be desirable to maintain the integrity of labels on the wine bottles. In this regard, it will be appreciated that for wine collectors the condition of the wine labels on a bottle are of some importance. That is, if the wine labels of the bottles are damaged, the value of the bottle of wine may be impaired. This is true for both the body label of a wine bottle as well as the neck label of the wine bottle. Therefore, it may be desirable that the wine storage system and allow for reducing contact with such labels while securely holding the wine bottle and permitting inspection thereof. Accordingly, the inventive wine rack systems disclosed herein allow for holding multiple wine bottles in a generally horizontal configuration, permitting airflow between individual bottles and securely holding individual bottles. Furthermore, the presented systems may reduce wear that may be applied to one or both labels of a wine bottle.

Figure 1A:
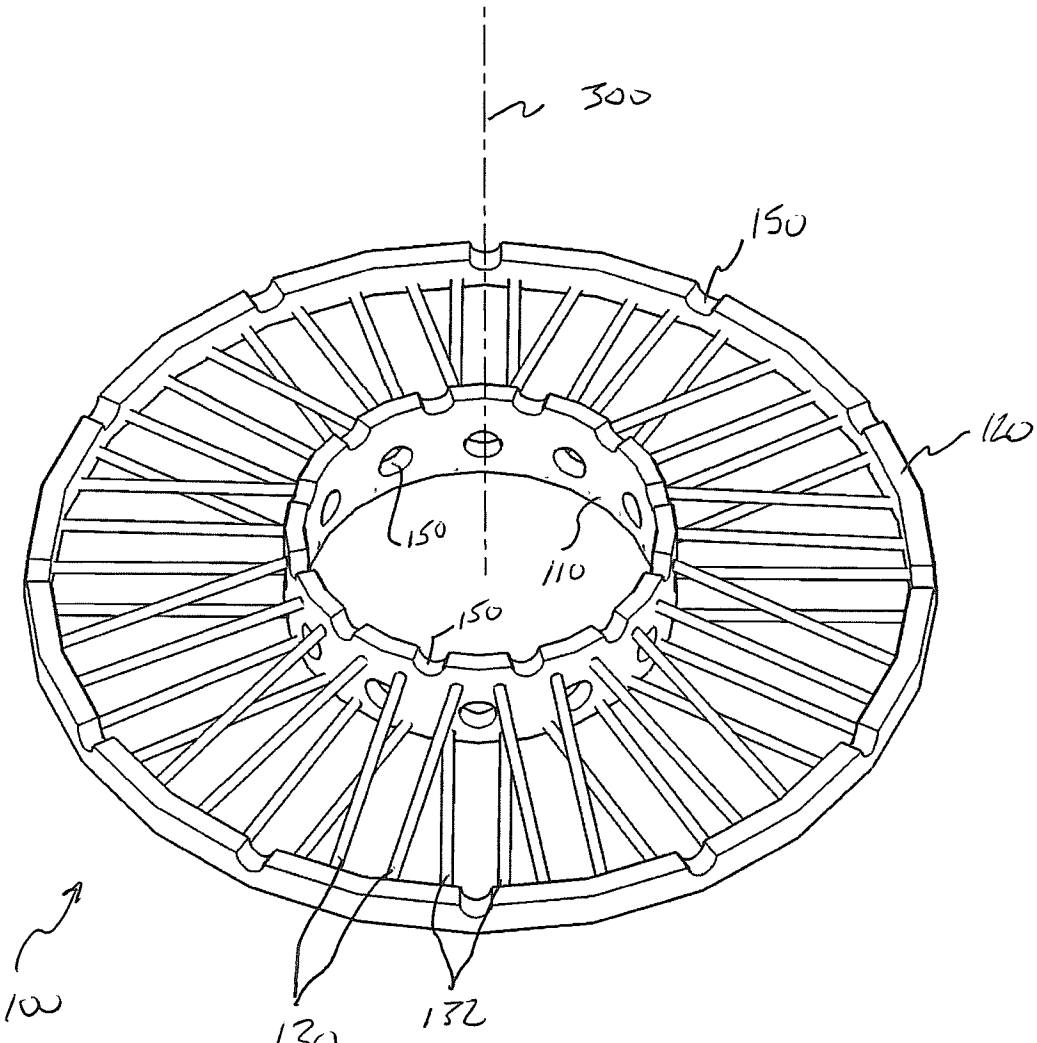
FIG. 1A illustrates a perspective view of one embodiment of the wire rack carousel.

FIG. 1A illustrates a first embodiment of wine rack carousel 100 in accordance with various aspects of the present invention. As illustrated, the wine rack carousel 100 includes an inner annular frame 110 and an outer annular frame 120. As shown, these annular frames are circular and concentrically disposed about a central axis 300. A plurality of pairs of bottle support elements 130, 132 extend between the inner and outer frames 110, 120 connecting the frames. These bottle support elements are generally formed of elongated members (e.g., dowels) that have first and second ends that are inset into corresponding apertures formed in the side surfaces of the inner frame 110 and outer frame 120. The spacing between each individual pair of bottle support elements 130 or 132 is such that a wine bottle disposed between such a pair of bottle support elements extends partially there between. That is, a horizontal spacing between each pair of bottle support elements 130 or 132 is less than the width of the wine bottle 200. In this regard, when a wine bottle 200 is supported along its length by the elements and rests partially there between. See, e.g. FIGS. 2A and 2B.

Figure 1B:
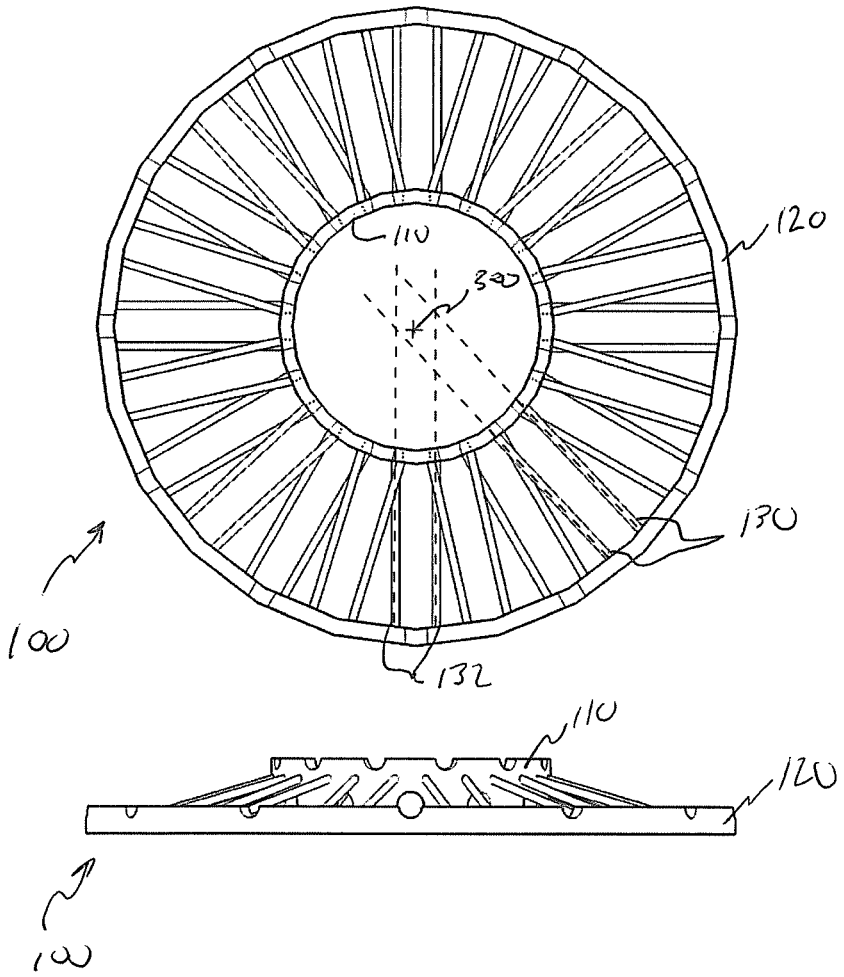
FIG. 1B illustrates a top and side plan views of the wine rack carousel of FIG. 1A.

To maintain the correct positioning of the bottles, each pair of bottle supports 130 or 132 are parallel. That is, rather than extending radially outward from the central axis 300 of the wine rack carousel 100, each pair of bottle supports 130 or 132 is offset from the central axis 300 as shown by phantom lines as illustrated in FIG. 1B. This prevents the space between the inner ends of each pair of supports from being narrower than the space between the outer ends of each pair of supports. In order to reduce the potential for wear on the body label of a bottle of wine 200 supported by the support elements 130 or 132 the support elements are rounded. That is, all hard edges are removed from the support elements in order to lessen the possibility of the support elements abrading the body labels of the supported wine bottles 200. In one such arrangement the support elements 130 are formed of, for example, round wooden dowels or other circular rods. In any arrangement, these supports have a first end that is received within apertures 140 formed at least partially into the outer surface of the inner annular frame and a second end disposed in apertures (not shown) formed at least partially into the inner surface of the outer annular frame.

Figure 1C:
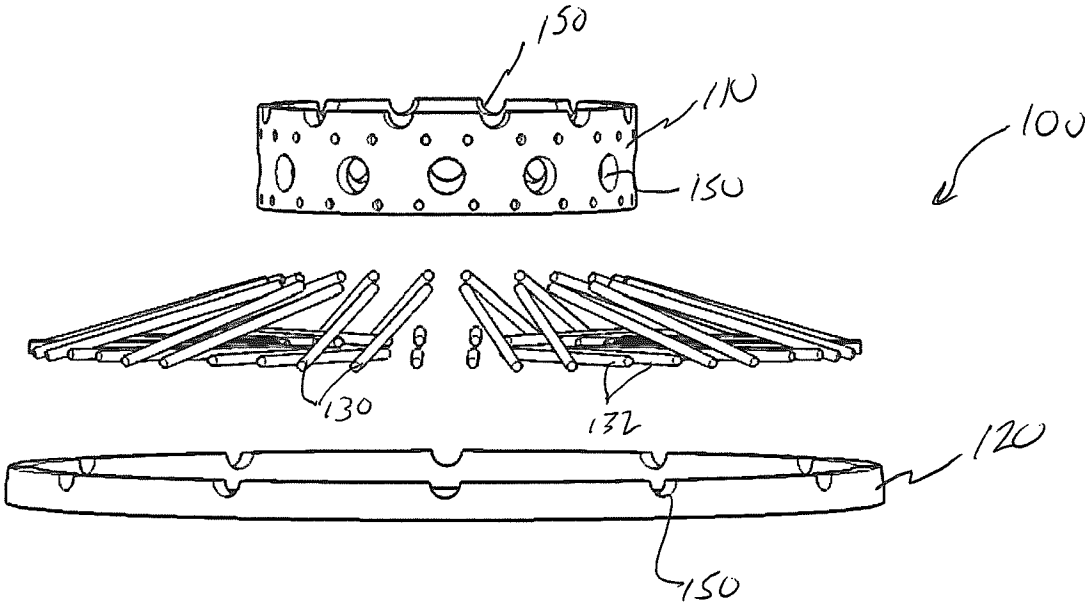
FIG. 1C illustrated an exploded perspective view of the wine rack carousel of FIG. 1A.
Figure 2A:
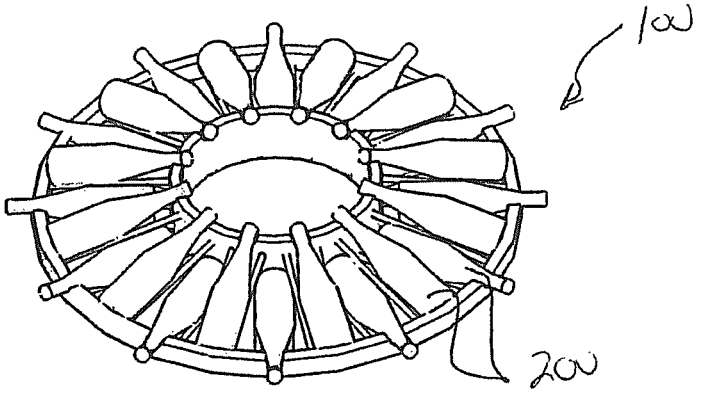
FIG. 2A illustrates the wine rack holding bottles where the bottle necks alternate inward and outward.
Figure 2B:
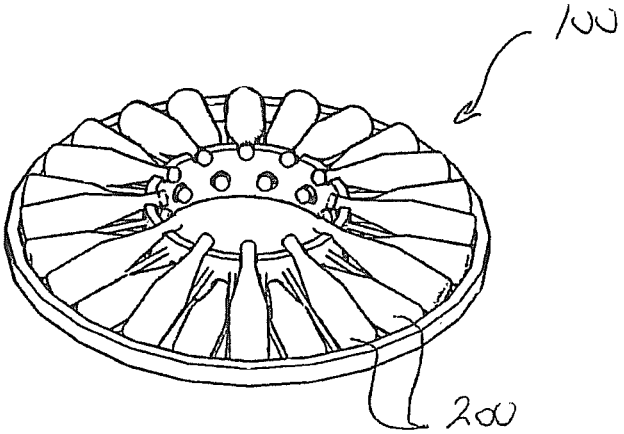
FIG. 2B illustrates the wine rack holding bottles where all the bottle necks face inward.

As shown in FIGS. 1A-1C the inner annular frame 110 has a height that is significantly greater than the height of the outer annular frame 120. In the present embodiment, this permits each of the first pairs of bottle supports 130 to be disposed at an angle relative to the central axis 300 while each of the second pairs of bottle supports 132 are substantially perpendicular to the central axis 300. In this regard, the carousel 100 is operative to support two rows of wine bottles as illustrated in FIGS. 2A and 2B. That is, while the outer ends of the bottle supports may engage the inside surface of the outer annular frame 120 has substantially common height (i.e., as measured from the bottom edge of the outer frame) members the inner ends of the bottle supports engage the outside surface of the inner frame at two different heights (i.e., as measured from the bottom edge of the inner frame). As noted, this allows for supporting a first row bottles at an angle and sporting a second row bottles substantially horizontal in relation to the vertical central axis. A further benefit of having to sets of supports the engage the inner frame at different locations is a significant stiffening of the overall carousel 100. That is, by engaging the inner frame 110 at a higher and lower location, the structural support provided between the inner and outer frames is greatly increased.

Figure 3A:
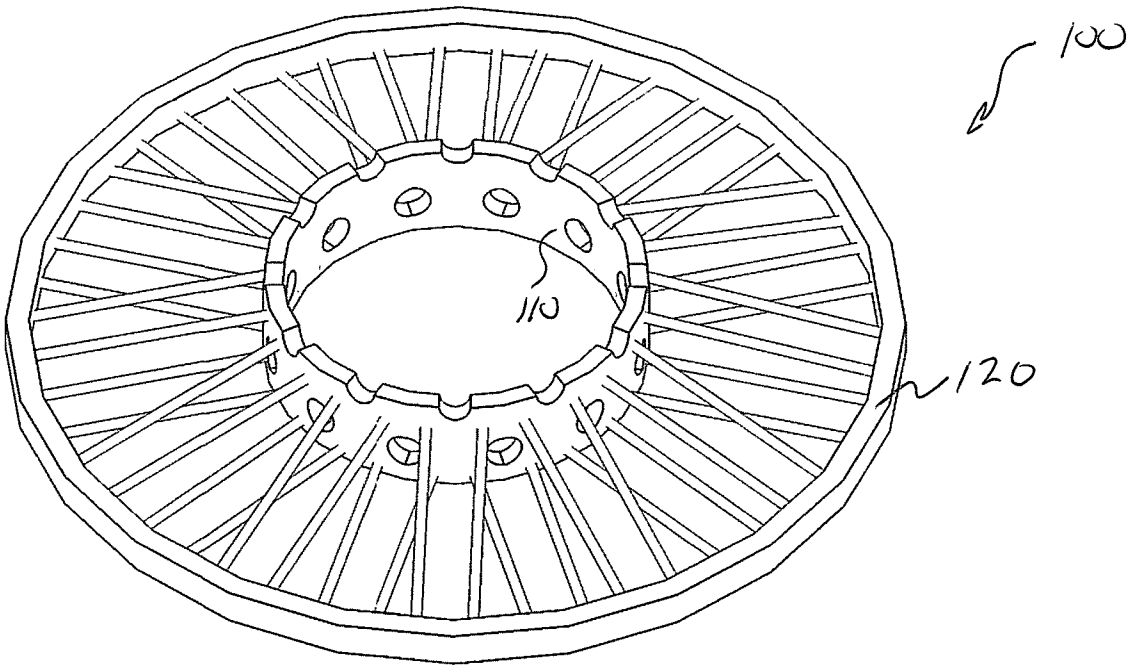
FIG. 3A illustrates a further embodiment of the wine rack carousel.
Figure 3B:
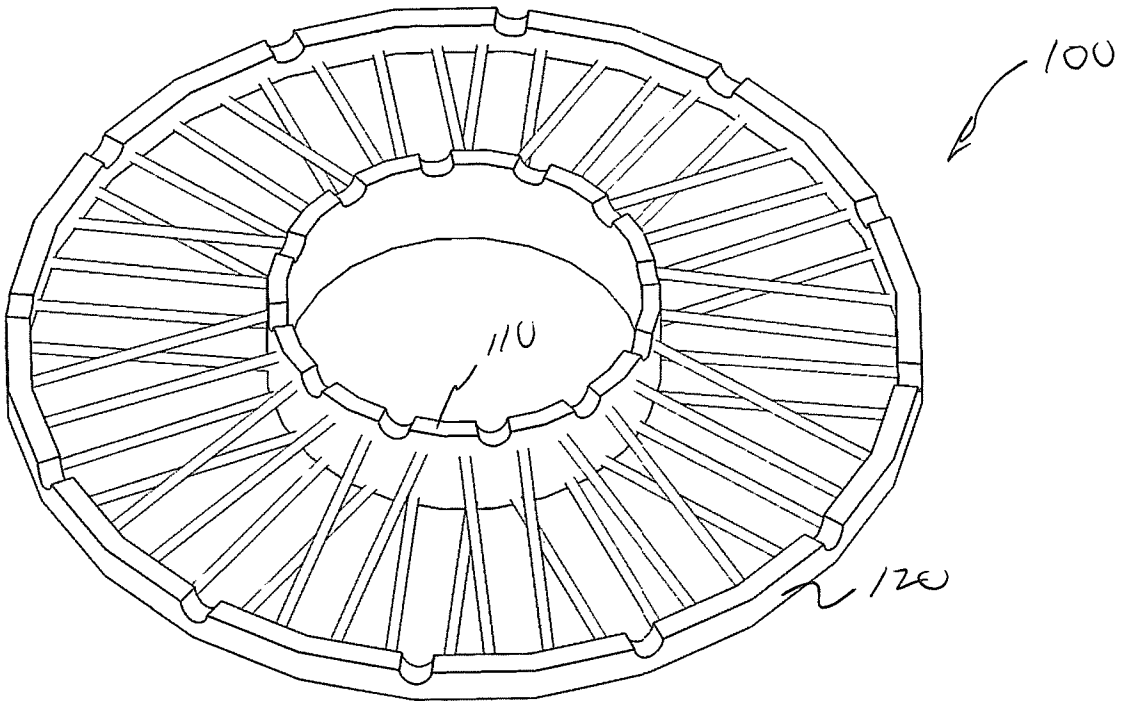
FIG. 3B illustrates a yet further embodiment of the wine rack carousel.

Referring to FIGS. 1A-1C and 2A, is noted that in the inner and outer support frames includes a plurality of cutouts 150 that allow for the neck of a bottle 200 to extend partially through these front support. By including a cutout 150 in the outer support frame, the direction of the bottles may be alternated as illustrated in FIGS. 2A and 2B. FIG. 3A illustrates an alternate embodiment of the carousel 100 that is substantially identical to the embodiment of FIG. 1A except for the outer annular frame 120 is free of cutouts. In this arrangement, all the bottles may be disposed inward as illustrated in FIG. 2B. FIG. 3B illustrates an alternate embodiment of the carousel 100 that is substantially identical to the embodiment of FIG. 1A except for the inner annular frame 120 is free of cutouts for the lower sets of supports. In this arrangement, the horizontal tier of bottles may only be disposed outward as illustrated in FIG. 2A. In any embodiment, the inclusion of the cutouts 150 allows for easily inserting and removing the bottles from the wine rack carousel 100. Further, it will be noted that many bottles include a neck label. Accordingly, if the neck of the bottle rested upon the cutout 150 there could be potential to damage the neck label. To prevent such damage, the present system 100 may utilize cutouts 150 that are disposed beneath the neck of bottle supported by the pairs of support members 130 or 132, as the case may be. Stated otherwise, the support members 130 are positioned into the frames 110 or 120 at a height that elevates the neck of the support of bottle above the surface of the cutout 150. Accordingly, this lessens the likelihood of abrasion between the cut out 150 and the neck label.

Referring to FIGS. 2A and 2B, it is noted that when a bottle 200 is positioned between the inner and outer frames 110, 120 the bottle is protected from dislodgment from the wine rack carousel 100 by the inner and outer frames. Thus, the carousel provides a secure system for holding wine bottles.

Figure 4:
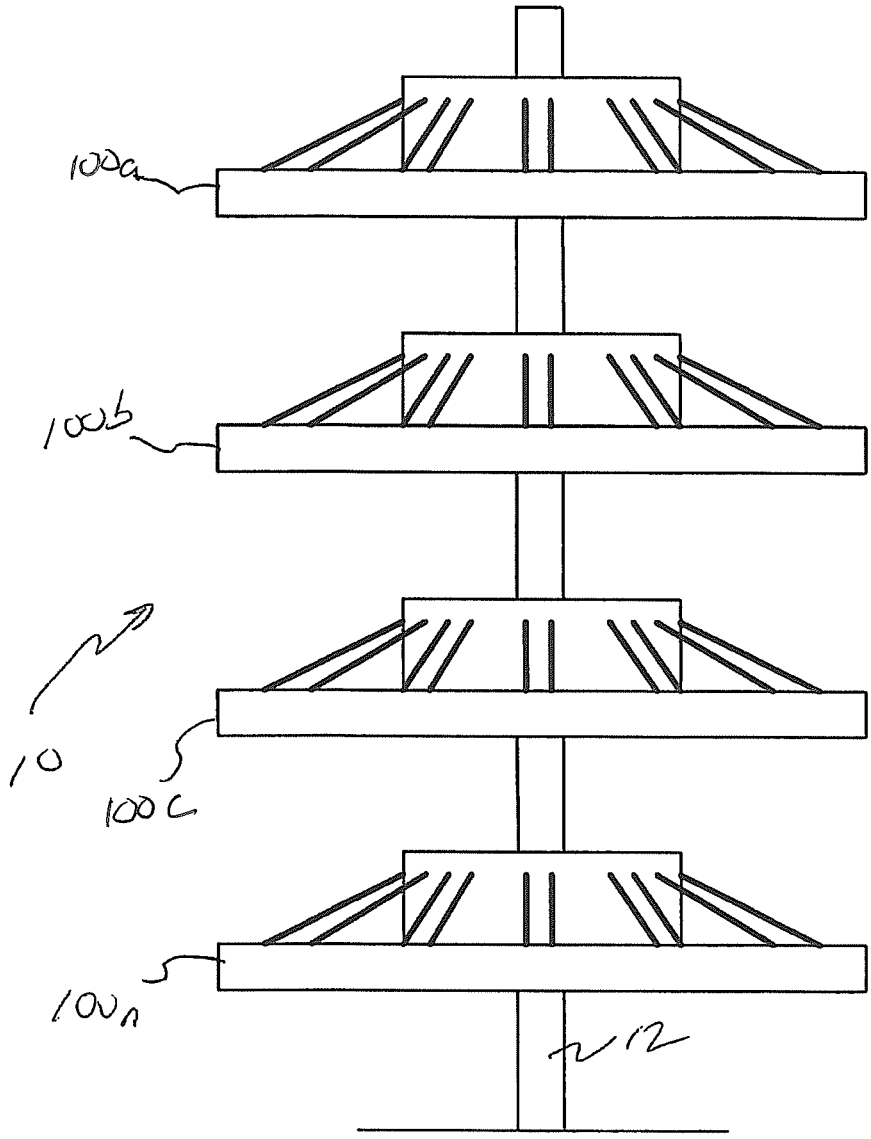
FIG. 4 illustrates the wine rack carousel in a tiered arrangement.

In any of the noted embodiments, the wine rack carousel may be a modular system 10. That is, a plurality of individual wine carousels 100*a-n* (tiers) may be disposed along a common central axis (e.g., support post 12). FIG. 4 illustrates a wine carousel that utilizes multiple tiers. As shown, multiple individual carousels 100 may be attached to the common support 12. Further, the individual carousels may be coupled to the support post to allow its individual rotation. That is, as there are not physical connections between adjacent tiers (e.g., except the support post), each carousel may be individually rotated free of rotating an adjacent carousel The foregoing description of the wine rack design has been presented for purposes of illustration and description. Furthermore, the description is not intended to limit the invention to the form disclosed herein. Consequently, variations and modifications commensurate with the above teachings, and skill and knowledge of the relevant art, are within the scope of the invention. The embodiments described hereinabove are further intended to explain best modes known of practicing the invention and to enable others skilled in the art to utilize the invention in such, or other embodiments and with various modifications required by the particular application(s) or use(s) of the invention. It is intended that the appended claims be construed to include alternative embodiments to the extent permitted by the prior art.

What is claimed is:

1. A wine rack comprising:

an inner annular frame;

an outer annular frame, wherein said inner annular frame and said outer annular frame are substantially concentric about a vertical central axis and a lower peripheral edge of said outer annular frame defines a horizontal reference plane; and a first plurality of horizontal pairs of support rods that extend between said inner annular frame and said outer annular frame substantially parallel to said horizontal reference plane; and a second plurality of slanted pairs of support rods that extend between said inner annular frame and said outer annular frame at an angle to said horizontal reference plane, wherein each pair of support rods are parallel to one another and spaced to support a wine bottle there between and wherein said first plurality of horizontal pairs of support rods and said second plurality of slanted pairs of support rods alternate about a periphery of said inner annular frame to alternately support wine bottles in horizontal and slanted orientations.

2. The wine rack of claim 1, wherein a height of said inner annular frame is greater than a height of said outer annular frame.

3. The wine rack of claim 2, wherein outer ends of said first plurality of horizontal pairs of support rods and said second plurality of slanted pairs of support rods attach at a substantially common height along the height of said inside surface of said outer annular frame.

4. The wine rack of claim 2, wherein inner ends of said first plurality of horizontal pairs of support rods attach to said outside surface of said inner annular frame at a first height and inner ends of said second plurality of slanted pairs of support rods attach to said outside surface of said inner annular frame at a second height, wherein said second height is greater than said first height.

5. The wine rack of claim 1, wherein the inner annular frame comprises a plurality of cut-outs for receiving necks of a plurality of wine bottles.

6. The wine rack of claim 1, wherein the support rods in each of said pairs of support rods are spaced apart to support a wine bottle where the neck of the wine bottle sits within a cut-out but does not contact said inner annular frame.

7. The wine rack of claim 1, wherein said outer annular frame comprises a plurality of cut-outs for receiving necks of a plurality of wine bottles.

8. The wine rack of claim 1, wherein said support rods are cylindrical in shape.

9. The wine rack of claim 1, further comprising:

a central support disposed along said central axis, wherein said inner annular frame is rotatively coupled to said central support.

10. The wine rack of claim 9, wherein said inner annular frame and said outer annular frame comprise a first inner annular frame and a first outer annular frame, further comprising:

a second inner annular frame and a second outer annular frame connected by a plurality of support rods extending between an outside surface of said second inner annular frame and an inside surface of said second outer annular frame, wherein said first inner annular frame is rotatively coupled to said central support at a first location and said second inner annular frame is rotatively coupled to said central support at a second location.

11. The wine rack of claim 10, wherein said first inner and outer annular frame and said second inner and outer annular frame are configured to rotate free of the other inner and outer annular frame.

* * * * *